US006745504B2

(12) United States Patent
Sastre et al.

(10) Patent No.: US 6,745,504 B2
(45) Date of Patent: Jun. 8, 2004

(54) STEAM IRON

(75) Inventors: Desideri Falcó Sastre, Barcelona (ES); Francesc Carreras Devesa, Sant Just Desvern (ES); Vicenc Font Manent, Barcelona (ES); Juan Carlos Coronado Sanz, Barcelona (ES); Antonio Rebordosa Rius, Sant Fruitós de Bages (ES); Xavier Cuesta Mundet, Barcelona (ES)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/321,243

(22) Filed: Dec. 17, 2002

(65) Prior Publication Data

US 2003/0221341 A1 Dec. 4, 2003

(30) Foreign Application Priority Data

May 31, 2002 (DE) ..... 102 24 549

(51) Int. Cl.[7] ..... D06F 75/18
(52) U.S. Cl. ..... 38/77.82
(58) Field of Search ..... 38/74, 77.1, 77.8, 38/77.81, 77.82, 77.83

(56) References Cited

U.S. PATENT DOCUMENTS 2,387,281 A 10/1945 Morton et al.
2,892,272 A * 6/1959 Finlayson et al. ..... 38/77.81
3,002,302 A * 10/1961 Flowers ..... 38/77.5
3,780,457 A * 12/1973 Gowdy et al. ..... 38/77.81
4,748,755 A * 6/1988 Bain et al. ..... 38/88
5,421,110 A * 6/1995 Morrissey et al. ..... 38/77.82
5,531,037 A * 7/1996 Pons et al. ..... 38/77.8

FOREIGN PATENT DOCUMENTS

| | | |
|---|---|---|
| DE | 1 585 854 | 10/1970 |
| DE | 33 28 453 C1 | 1/1985 |
| DE | 37 15 059 C1 | 8/1988 |
| JP | 05329299 | 12/1993 |

* cited by examiner

*Primary Examiner*—Ismael Izaguirre
(74) *Attorney, Agent, or Firm*—Fish & Richardson P.C.

(57) ABSTRACT

Steam iron having a sole plate with a steam chamber, and a sealed liquid reservoir. A drip valve supplies the steam chamber with liquid from the liquid reservoir. One or more one-way gas valves between the liquid reservoir and ambient air let air enter the reservoir in response to local negative pressures within the reservoir caused by movement of water within the reservoir, such as during reciprocal ironing motion. A pressure-equalizing passage is formed within a manually operable rod of the drip valve, such that only one opening is required in the lower wall of the liquid reservoir.

56 Claims, 5 Drawing Sheets

STEAM IRON

CROSS REFERENCE TO RELATED APPLICATION

This application claims priority to German Patent Application No. DE 102 24 549.5, filed May 31, 2002, which is incorporated herein by reference in its entirety.

TECHNICAL FIELD

This invention relates to a steam iron having a steam chamber and a liquid reservoir.

BACKGROUND

In the case of a steam iron with a drip valve, water is introduced drop by drop from the water tank or liquid reservoir into a heated steam chamber. The steam generated in the steam chamber passes out of the sole plate through steam-outlet openings and comes into contact with the article which is to be ironed. The steam pressure in the steam chamber here usually corresponds merely to the atmospheric pressure or is increased by the value made up by the height of the water column in the water tank and the atmospheric pressure exerted thereon.

The steam-outlet openings are usually enclosed by a sole-plate surface, with the result that, in the case of particularly dense articles for ironing, such as denim, and/or an ironing board which is not particularly permeable to steam (e.g., made of wood), the steam pressure which can be generated by a steam iron with a drip valve is insufficient for discharging sufficient steam from the steam-outlet openings. In this case, on account of the articles for ironing not being particular permeable to steam, an elevated steam pressure builds up in the steam chamber, which is in pressure-equalizing connection with the steam outlet openings. The elevated steam pressure of the steam chamber is thus present on one side of the drip valve, said steam pressure opposing the atmospheric and water column pressure on the other side of the drip valve. The quantity of steam applied to the articles for ironing thus further decreases to a considerable extent.

In order to tackle this problem, it has been known for some time flow to connect the steam chamber to a liquid-free region of the water tank (the water tank is not completely filled) by means of a pressure-equalizing tube. By means of this solution, a steam pressure of the steam chamber, once elevated for example by the type of articles for ironing, no longer opposes the atmospheric pressure on the other side of the drip valve.

In practice, the hitherto used detailed solutions for a steam iron with pressure-equalizing device, although achieving an improved result, have not produced a sufficiently satisfactory result. In the case of portable steam irons according to DE 33 28 453, U.S. Pat. No. 2,387,281, U.S. Pat. No. 2,892,272 or GB 1,234,856, problems can arise if the water in the tank of the steam iron is moved back and forth by a normal ironing movement. As a result, for example, the steam directed into the water tank from the steam chamber is condensed on the tank wall by the water waves. With a water vapor to water volume ratio of approximately 1000 to 1, the condensation results in an undesirable drop in pressure and/or negative pressure in the water tank. The pressure fluctuations in the water tank which are generated by the wave movement of the water likewise have a disadvantageous effect on the pressure equilibrium between the steam chamber and water tank and on the pressure present at the drip valve.

It is thus an object of the present invention to provide a steam iron with pressure-equalizing device of the above-mentioned type which eliminates the disadvantages of the prior art, which discharges a sufficient quantity of steam in particular even during movement of the steam iron and which manages without modifications which would result in higher production outlay in comparison with conventional technical solutions.

SUMMARY

Various aspects of the invention feature a steam iron of the drip-valve type in which a pressure-equalizing device, such as a connecting tube, is arranged between a liquid reservoir and a steam chamber. The liquid reservoir and the liquid-filling region are preferably each not just liquid-tight, but also gas-tight, at least in a region of a pressure-equalizing passage between the liquid reservoir and steam chamber, such that it is possible to build up a gas pressure in the liquid reservoir. Provided in the region of the wall of the liquid reservoir of the liquid-filling region is a first one-way gas valve, through which ambient air can enter into the liquid reservoir.

Preferably, the first one-way gas valve opens automatically, such as in response to a certain threshold pressure value. It is preferable that the threshold pressure value be at or below atmospheric pressure. Accordingly, under negative gage pressure in the liquid reservoir, ambient air can be introduced into the liquid reservoir through the first one-way gas valve. The inherently disruptive wave movement of the water in the liquid reservoir, as described above, is thus advantageously exploited. The water moving back and forth in the liquid reservoir, usually to a pronounced extent as a result of the movement of the iron, functions effectively as a reciprocating pump or "thermal pump" with the water acting as a moving piston. In the case of the water moving in the liquid reservoir, it is usually the case that one end region of the liquid reservoir is loaded with water to a considerably greater extent than an opposite region. A negative pressure is thus produced in the region of the liquid reservoir with the lower water content. A one-way gas valve arranged in a wall of the liquid reservoir in this negative-pressure region thus allows ambient air to enter, with the result that the movement of the water back and forth in the liquid reservoir leads to continuous replenishing with ambient air through the one-way gas valve.

In a further advantageous embodiment of the steam iron, a second one-way gas valve is provided on a wall of the liquid reservoir or of the liquid-filling region, the second valve allowing gas to pass out of the liquid reservoir in the opposite direction to the first one-way gas valve. This second one-way gas valve is preferably designed such that it opens automatically, such as in response to a positive threshold pressure value in the liquid reservoir, with the result that, in the case of a certain positive pressure in the liquid reservoir, gas is discharged from the liquid reservoir through the second one-way gas valve.

The threshold pressure value of the second one-way gas valve is preferably set at a positive gage pressure of greater than about 50 mbar (in some cases, greater than about 100 mbar), preferably at a level that does not occur during normal use of the steam iron. The second valve has a safety function in that it helps to avoid more extreme pressures in the liquid reservoir or steam chamber when the steam outlet openings are closed.

In some embodiments, the second one-way gas valve is designed as a closure of the liquid-filling region. The closure may latch into the housing or the wall of the liquid reservoir, for example, by means of a snap-in connection. The force which is necessary to release this snap-in connection is defined such that it corresponds to the positive threshold pressure value of the second one-way gas valve.

In some advantageous embodiments of the invention, there is no need for a second connection, requiring insulation and/or sealing, for the pressure-equalizing device between the liquid reservoir and steam chamber. For example, the drip valve may be provided with an inner tube, the cavity of which serves as a pressure-equalizing device.

According to one aspect of the invention, a steam iron has a sole plate with steam outlet openings in steam connection with a steam chamber, a heater that heats the sole plate and the steam chamber for the purpose of generating steam, and a liquid reservoir with a drip valve for supplying the steam chamber with liquid from the liquid reservoir. A pressure-equalizing passage extends between a first opening in the steam chamber and a second opening in a gas-tight region of the liquid reservoir. A first one-way gas valve is arranged between the liquid reservoir and ambient air to permit air to enter the liquid reservoir through the valve while impeding fluid flow from the liquid reservoir to the ambient air.

In some embodiments the one-way gas valve is arranged with respect to the liquid reservoir to cause air to enter the reservoir through the valve in response to motion of reservoir contents during motion of the iron during use. Preferably, the valve repetitively operates in response to normal reciprocating motion of the iron.

The one-way gas valve preferably opens automatically to permit air to enter the reservoir in response to pressure within the reservoir falling to below a predetermined threshold pressure. The predetermined threshold pressure is preferably less than or substantially equal to ambient atmospheric pressure.

In some cases, the drip valve is in the form of a channel defined between a movable rod and a wall separating the liquid reservoir and steam chamber. The rod may be operably connected to a knob exposed on the iron for manual manipulation by an operator, for example. In some embodiments, the rod also defines an internal cavity forming the pressure-equalizing passage between the liquid reservoir and steam chamber, advantageously reducing the number of holes necessarily formed in a lower wall of the reservoir.

The one-way gas valve is preferably located at one longitudinal end region of the liquid reservoir, Such as at a forward end.

In some embodiments, the iron has two such one-way gas valves arranged between the liquid reservoir and ambient air, the gas valves being disposed at opposite ends of the liquid reservoir.

In some instances, the gas valve is in the form of a ball check valve.

Some examples have a second one-way gas valve arranged between the liquid reservoir and ambient air, to permit air to leave the liquid reservoir through the valve. The second one-way gas valve preferably opens automatically to permit air to leave the reservoir in response to pressure within the reservoir rising to above a predetermined maximum threshold pressure. The predetermined maximum threshold pressure is preferably greater than normal reservoir operating pressure.

In some embodiments, the second one-way gas valve is manually openable for filling the liquid reservoir. In this way, the valve also serves as a closure of a liquid filling region.

Another aspect of the invention features a method of controlling, pressure in a liquid reservoir of a portable steam iron, incorporating many of the above-described features.

Another aspect of the invention features ironing clothes with the above-described steam iron.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
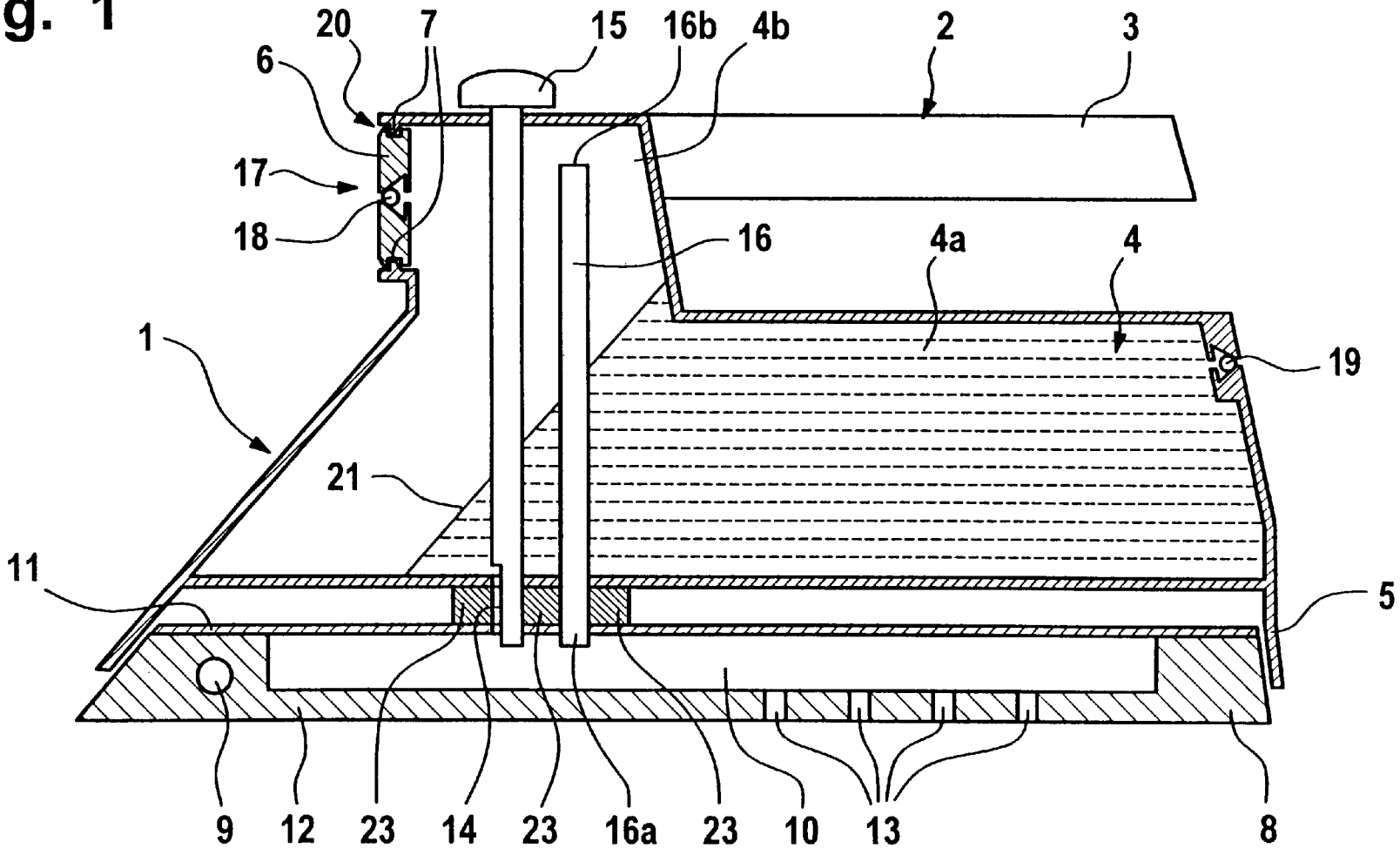
FIG. 1 shows a schematic sectional illustration through a steam iron with pressure-equalizing device, with the water in the liquid reservoir moved to the rear.

FIG. 1 shows, schematically, a longitudinal section through a steam iron 1 with a housing 2 which comprises a handle 3, a liquid reservoir 4 and a bottom skirt 5. The liquid reservoir 4 has an essentially longitudinal extent, with a section of lesser height 4*a* and a section of greater height 4*b*. As is customary, the liquid reservoir is never completely filled with water, with the result that the section of lesser height is readily filled up with water and the section of greater height 4*b* retains a water-free region with air remaining therein. A closure 6 is formed in a front region of the liquid reservoir and can be opened by sliding or pivoting, with the result that water can be filled into the liquid reservoir. The closure preferably has a snap-in connection, with the result that it can be closed by snap-in action on the wall adjacent to the liquid reservoir or housing 2. Sealing means 7 are provided about the closure 6 adjacent to the wall of the housing 2. The water-enclosing wall of the liquid reservoir and of the liquid-filling region 17 with closure 6 and sealing 7 is not just liquid-tight, but is also gas-tight, such that it is possible to build up a gas pressure in the liquid reservoir.

A die-cast body 8 is provided in a bottom region of the steam iron 1. A heating device 9 is cast in the die-cast body 8. The die-cast body has a cavity or a recess which serves as a steam chamber 10. The steam chamber 10, along with the adjacent die-cast body 8, is closed at the top by a steam-chamber cover 11. A sole plate 12 with an ironing surface is formed in a bottom region of the die-cast body. The sole plate 12 may be fastened, as a sheet-metal part, in a composite arrangement on the cast body 8, or may be formed directly by the underside of the cast body 8. The sole plate 12 defines a plurality of steam-outlet openings 13 which are in steam connection with the steam chamber 10.

The steam iron 1 also has a drip valve 14, which may be designed, for example, as a recessed channel in a longitudinal rod. Through the lateral recessed channel in the rod, water from the liquid reservoir 4 passes drop by drop into the steam chamber 10. The water droplets come into contact with the hot inner side of the steam chamber and evaporate. At the other end of the rod-like drip valve 14, a steam regulator 15 is provided on the top outer side of the housing. The steam regulator 15 allows adjustment of the quantity of water let into the steam chamber 10 and/or the quantity of steam generated.

Also provided is a pressure-equalizing device 16 which is designed as a tube, The first opening 16*a* of the pressure-equalizing device 16 projects into the steam chamber 10. The second opening 16*b*, or the other end of the tube of the pressure-equalizing device 16, projects into the higher region 4*b* of the liquid reservoir 4. The second opening 16*b* thus terminates in a region of the liquid reservoir 4 which is not wetted by the watch of the liquid reservoir 4 when the steam iron is either horizontal (e.g., during use) or vertical (e.g., when standing). The pressure-equalizing device 16 ensures pressure equalization between the steam chamber pressure and the pressure in the liquid reservoir. This is important, in particular, when, as a result of particularly dense articles being ironed, for example, it is barely possible for steam to pass out of the steam-outlet openings.

A first one-way gas valve 18 is arranged at one end section of the liquid reservoir, preferably in the longitudinal direction, preferably in the closure of the liquid-filling region 17. The first one-way gas valve is purely a gas valve, that is to say it is liquid-tight. It is designed, for example, as a ball valve and opens in response to a predetermined threshold pressure value. This threshold pressure value is preferably negative (i.e., below atmospheric pressure) or zero (i.e., substantially equal to atmospheric pressure), such that when pressure in the liquid reservoir 4 is negative, ambient air passes into the liquid reservoir through the first one-way gas valve 18, immediately reducing or equalizing the negative pressure in the reservoir. In some cases, a further first one-way gas valve 19 is arranged it the other end region of the liquid reservoir, more or less opposite the first one-way gas valve 18, and also allowing air to pass into the reservoir in response to locally negative reservoir pressure.

Also provided in the region of the liquid-filling region 17 is a second one-way gas valve, which opens automatically in the case of a predetermined positive pressure value in the liquid reservoir, for dissipating excess positive pressure in the reservoir.

The second one-way gas valve 20 may be designed in a manner, analogous to the first one-way gas valve 18, for example as a ball valve, although in this case it is spring-loaded and acts in the opposite direction to the first one-way gas valve. The spring pressure to which the ball is loaded in this case defines the threshold pressure value from which the second one-way gas valve 20 opens. Alternatively, the second one-way gas valve may be formed integrally with closure 6 without conventional valve devices such as a ball valve. For example, closure 6 has a snap-in connection in relation to the housing 2 which opens in response to a predetermined force applied from within the liquid reservoir. This opening of the closure 6 thus corresponds to an opening of a second one-way gas valve 20.

FIG. 1 shows the steam iron being moved forward in the longitudinal direction, towards the tip of the sole plate. The water 21 located in the liquid reservoir 4 has collected predominantly in a rear region of the liquid reservoir. The front region of the liquid reservoir in this case has rather a low liquid content, a negative pressure being generated in the front region by the movement of the water. This negative pressure, however, is immediately dissipated by the first one-way gas valve 18, with the result that it is not transmitted from the liquid reservoir 4 to 15 the steam chamber 10 via the pressure-equalizing device 16. Without the first one-way gas valve, in the case of a negative pressure in the liquid reservoir, steam is taken into the liquid reservoir from the steam chamber, with the result that a smaller fraction of the steam passes out of the steam outlet openings 13.

Figure 2:
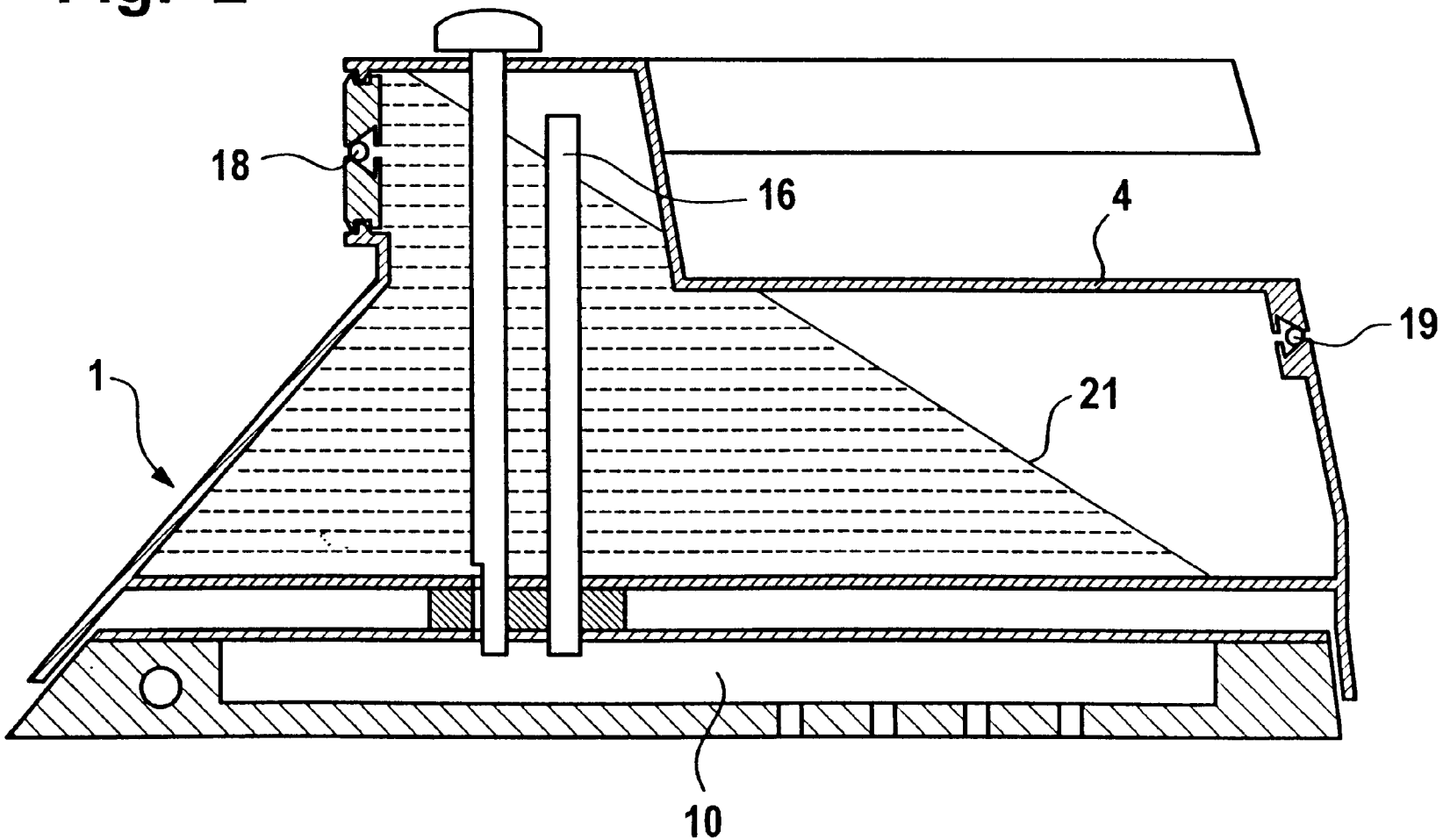
FIG. 2 shows the iron of FIG. 1, with the water in the liquid reservoir moved forward.

FIG. 2 shows the same steam iron as in FIG. 1, the difference being that the steam iron is being moved in the rearward direction, as a result of which more of the water 21 in the liquid reservoir 4 is collected in the front region of the liquid reservoir 4. The water and more of a positive pressure are thus present at the first one-way gas valve 18, with the result that the latter remains closed. The optional additional one-way gas valve 19 operates analogously to the first one-way gas valve 18 and, in the case of the movement of FIG. 2, releases the opening in order to equalize the negative pressure adjacent to the one-way gas valve 19. The one-way gas valve 19 is arranged, in FIGS. 1 and 2, in a rearmost region of the wall of the liquid reservoir 4. It is also possible, however, for it to be arranged adjacent to the handle, and level with the first one-way gas valve 18, on the wall of the liquid reservoir.

The water moving back and forth in the liquid reservoir 4 thus acts in a manner similar to a reciprocating pump and draws ambient air into the liquid reservoir 4 through the one-way gas valve 18 (and, if included, also through valve 19). In order that the one-way gas valves 18 and 19 act in optimum fashion relative to the pressure in the pressure chamber 10, it is advantageous if they are arranged adjacent to the second opening 16*b* (or 22*b* for the embodiment of FIG. 3) of the pressure-equalizing tube 16. In addition, the one-way gas valve(s) 18 and 19 are ideally arranged for it to be possible for a significant negative pressure to be produced adjacent the valve(s) by the movement of the water in the liquid reservoir 4.

Figure 3:
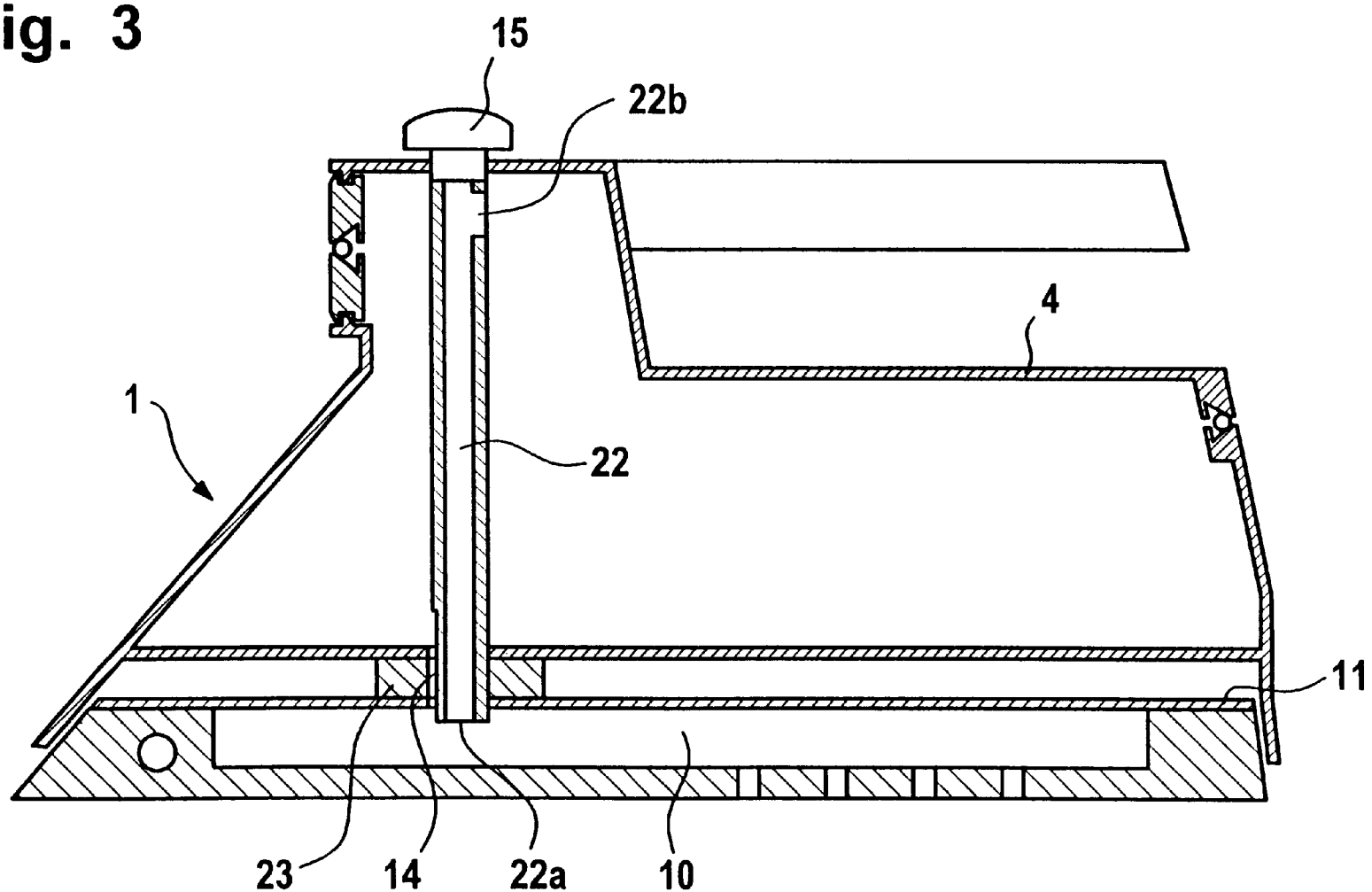
FIG. 3 shows a schematic sectional illustration of a steam iron with a pressure-equalizing device integrated into the drip valve.

FIG. 3 shows a steam iron 1 which is designed analogously to the steam iron according to FIGS. 1 and 2, the difference being that the rod-like drip valve 14 has an internal cavity 22 which serves as the pressure-equalizing device. In the same way, the first opening 22*a* of the pressure-equalizing device 22 terminates in the steam chamber 10 and the second opening 22*b* of the pressure-equalizing device 22 terminates, in the vicinity of the steam-regulating knob 15, at a lateral opening of the drip-valve rod 14 within the liquid reservoir 4. The drip valve 14, in the same way, is recessed laterally as a lateral channel in the wall of the rod or tube, with the result that the quantity of water fed to the steam chamber can be adjusted by way of this channel. This design provides just a single through-passage or a single opening in the base of the liquid reservoir and in the steam-chamber cover 11, with the result that it is also the case that sealing 23 is only necessary around this one opening.

Figure 4:
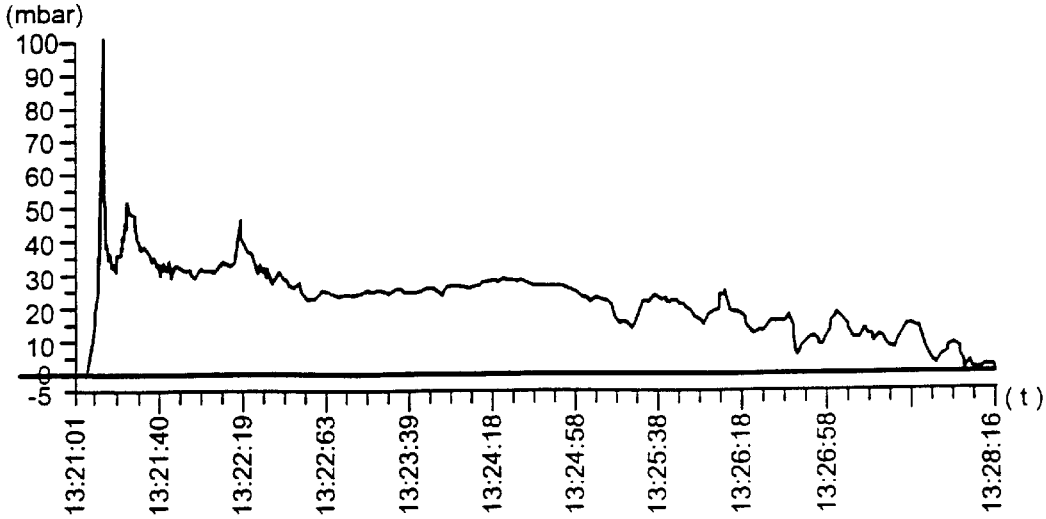
FIGS. 4 and 5 are time-based charts of pressure in the liquid reservoir of a portable steam iron not having a one-way gas valve, at rest and during movement of the iron, respectively.

FIG. 4 shows a chart of reservoir pressure with time plotted on the horizontal axis and a pressure in mbar is plotted on the vertical axis. The curve illustrated shows the pressure in the liquid reservoir in the case of a steam iron with a pressure-equalizing device but without a first one-way gas valve as described above, with the iron at rest. Accordingly, there is no wave movement in the liquid reservoir or sloshing of the water back and forth, with the result that no serious pressure fluctuations occur.

Figure 5:
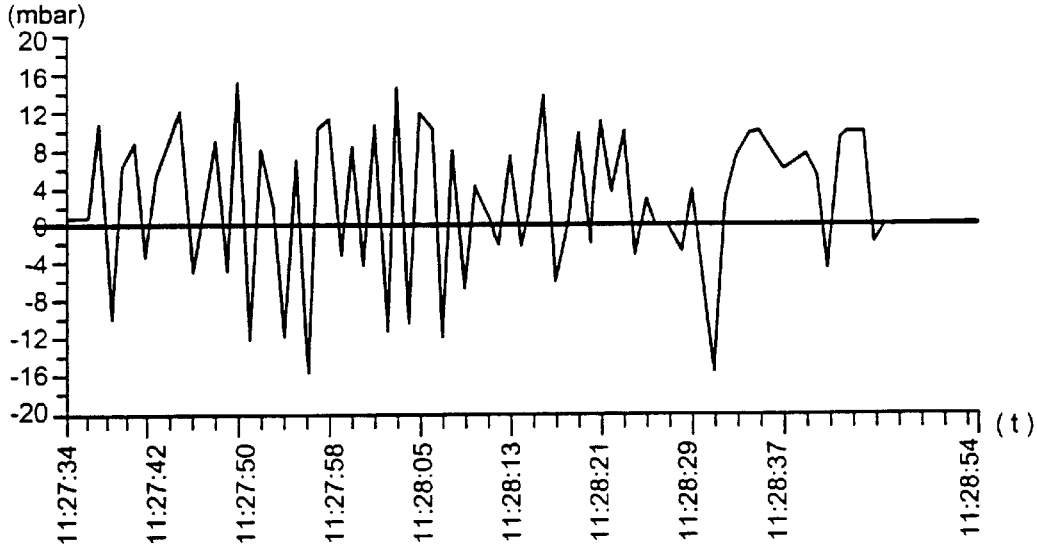

FIG. 5 shows the same pressure measurement as in FIG. 4, with the steam iron being moved back and forth. The wave movement of the water results in negative pressures which, on account of the connection to the steam chamber, affect the passage of the steam out of the steam outlet openings.

Figure 6:
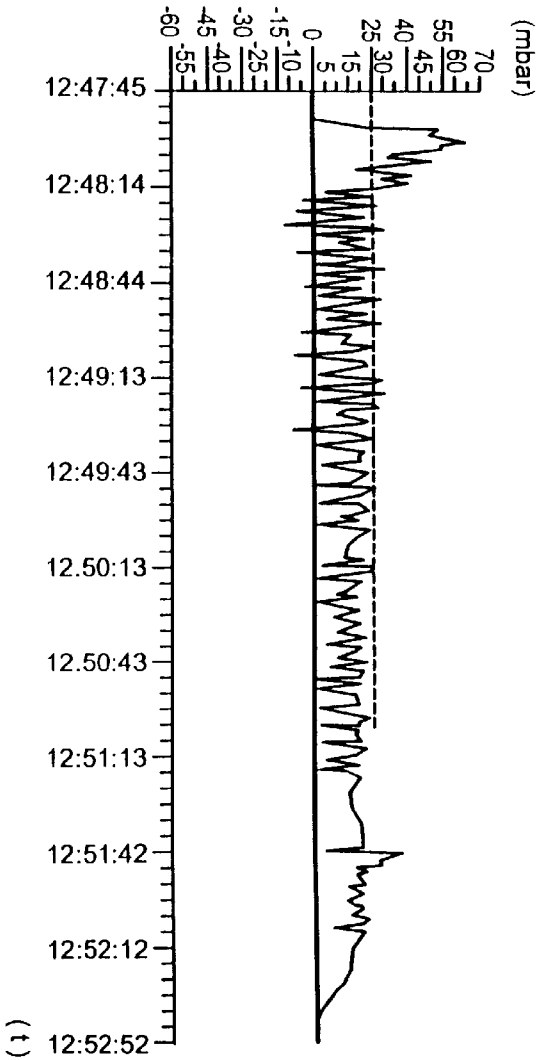
FIG. 6 is a time-based chart of reservoir pressure in a portable steam iron with a one-way gas valve, during movement of the iron.

FIG. 6 shows a chart of reservoir pressure with, once again, reservoir pressure in mbar illustrated on the vertical axis and elapsed time illustrated on the horizontal axis. Once again, the pressure in the liquid reservoir is measured during simultaneous movement of the steam iron and the contents of its liquid reservoir. In this case, however, a steam iron 1 according to FIGS. 1 to 3 has been used, a first one-way gas valve 18 being provided in the steam iron. It is thus possible overall to build up a somewhat higher pressure in the liquid reservoir, in which case negative pressures occur less often and to a lesser extent. Thus, despite the movement of the steam iron, a largely constantly high steam output at the steam outlet openings is possible. It is possible to achieve a constantly high quantity of steam irrespective of the nature of the articles being ironed and irrespective of the movement of the steam iron.

The steam iron is operated as follows: liquid drips into a steam chamber via a liquid reservoir, with the result that steam is generated in the steam chamber. The steam leaves a sole plate of the steam iron through steam outlet openings connected to the steam chamber. During normal movement of the iron back and forth, ambient air is let into the liquid reservoir via a one-way gas valve and an otherwise gas-tight design of the liquid reservoir, since the movement of the iron back and forth also moves the water located in the liquid reservoir back and forth, with the result that, in the manner of a piston of a reciprocating pump or a thermal pump, it generates a local negative pressure in the region of the liquid reservoir with a lower water content. A one-way gas valve arranged in this region thus allows ambient air into the liquid reservoir. The disruptive wave movement of the water in the liquid reservoir in the case of a steam iron that also has a pressure-equalizing device between the steam chamber and the liquid reservoir is thus exploited because pressure fluctuations in the liquid reservoir are compensated for by the movement of the water back and forth, with the result that it is possible to build up an overall higher pressure via the pressure-equalizing device.

A number of embodiments of the invention have been described. Nevertheless, it will be understood that various modifications may be made without departing from the spirit and scope of the invention. Accordingly, other embodiments are within the scope of the following claims.

What is claimed is:

1. A steam iron comprising a sole plate with steam outlet openings in steam connection with a steam chamber;

a heater that heats the sole plate and the steam chamber for the purpose of generating steam;

a liquid reservoir with a drip valve for supplying the steam chamber with liquid from the liquid reservoir, the drip valve being in the form of a channel defined between a movable rod and a wall separating the liquid reservoir and the steam chamber;

a pressure-equalizing passage extending between a first opening in the steam chamber and a second opening in a gas-tight region of the liquid reservoir, the pressure-equalizing passage being an internal cavity defined by the movable rod; and a first one-way gas valve arranged between the liquid reservoir and ambient air to permit air to enter the liquid reservoir through the valve while impeding fluid flow from the liquid reservoir to the ambient air.

2. The steam iron of claim 1 wherein the one-way gas valve is arranged with respect to the liquid reservoir to cause air to enter the reservoir through the valve in response to motion of reservoir contents during motion of the iron during use.

3. The steam iron of claim 1 wherein the one-way gas valve opens automatically to permit air to enter the reservoir in response to pressure within the reservoir falling to below a predetermined threshold pressure.

4. The steam iron of claim 3 wherein the predetermined threshold pressure is less than ambient atmospheric pressure.

5. The steam iron of claim 3 wherein the predetermined threshold pressure is substantially equal to ambient atmospheric pressure.

6. The steam iron of claim 1 wherein the rod is operably connected to a knob exposed on the iron for manual manipulation by an operator.

7. The steam iron of claim 1 wherein the one-way gas valve is located at one longitudinal end region of the liquid reservoir.

8. The steam iron of claim 1 wherein the one-way gas valve is located at a forward end of the liquid reservoir.

9. The steam iron of claim 1 having two first one-way gas valves arranged between the liquid reservoir and ambient air to permit air to enter the liquid reservoir through the valve while impeding fluid flow from the liquid reservoir to the ambient air, the gas valves being disposed at opposite ends of the liquid reservoir.

10. The steam iron of claim 1 wherein the gas valve is in the form of a ball check valve.

11. The steam iron of claim 1 further comprising a second one-way gas valve arranged between the liquid reservoir and ambient air, to permit air to leave the liquid reservoir through the valve.

12. The steam iron of claim 11 wherein the second one-way gas valve opens automatically to permit air to leave the reservoir in response to pressure within the reservoir rising to above a predetermined maximum threshold pressure.

13. The steam iron of claim 12 wherein the predetermined maximum threshold pressure is greater than reservoir operating pressure.

14. The steam iron of claim 12 wherein the second one-way gas valve is manually openable for filling the liquid reservoir.

15. A steam iron comprising:

a sole plate with steam outlet openings in steam connection with a steam chamber;

a heater that heats the sole plate and the steam chamber for the purpose of generating steam;

a liquid reservoir with a drip valve for supplying the steam chamber with liquid from the liquid reservoir;

a pressure-equalizing passage extending between a first opening in the steam chamber and a second opening in a gas-tight region of the liquid reservoir; and two first one-way gas valves arranged between the liquid reservoir and ambient air to permit air to enter the liquid reservoir through the valves while impeding fluid flow from the liquid reservoir to the ambient air, the gas valves being disposed at opposite ends of the liquid reservoir.

16. The steam iron of claim 15 wherein the one-way gas valves are arranged with respect to the liquid reservoir to cause air to enter the reservoir through the valve in response to motion of reservoir contents during motion of the iron during use.

17. The steam iron of claim 15 wherein the one-way gas valve opens automatically to permit air to enter the reservoir in response to pressure within the reservoir falling to below a predetermined threshold pressure.

18. The steam iron of claim 17 wherein the predetermined threshold pressure is less than ambient atmospheric pressure.

19. The steam iron of claim 17 wherein the predetermined threshold pressure is substantially equal to ambient atmospheric pressure.

20. The steam iron of claim 15 wherein the drip valve is in the form of a channel defined between a movable rod and a wall separating the liquid reservoir and steam chamber.

21. The steam iron of claim 20 wherein the rod is operably connected to a knob exposed on the iron for manual manipulation by an operator.

22. The steam iron of claim 15 wherein one of the one-way gas valves is located at one longitudinal end region of the liquid reservoir.

23. The steam iron of claim 15 wherein one of the one-way gas valves is located at a forward end of the liquid reservoir.

24. The steam iron of claim 15 wherein the gas valves are in the form of a ball check valves.

25. The steam iron of claim 15 further comprising a second one-way gas valve arranged between the liquid reservoir and ambient air, to permit air to leave the liquid reservoir through the valve.

26. The steam iron of claim 25 wherein the second one-way gas valve opens automatically to permit air to leave the reservoir in response to pressure within the reservoir rising to above a predetermined maximum threshold pressure.

27. The steam iron of claim 26 wherein the predetermined maximum threshold pressure is greater than normal reservoir operating pressure.

28. The steam iron of claim 26 wherein the second one-way gas valve is manually openable for filling the liquid reservoir.

29. A steam iron comprising a sole plate with steam outlet openings in steam connection with a steam chamber;

a heater that heats the sole plate and the steam chamber for the purpose of generating steam;

a liquid reservoir with a drip valve for supplying the steam chamber with liquid from the liquid reservoir;

a pressure-equalizing passage extending between a first opening in the steam chamber and a second opening in a gas-tight region of the liquid reservoir;

a first one-way gas valve arranged between the liquid reservoir and ambient air to permit air to enter the liquid reservoir through the valve while impeding fluid flow from the liquid reservoir to the ambient air; and a second one-way gas valve arranged between the liquid reservoir and ambient air, to permit air to leave the liquid reservoir through the valve.

30. The steam iron of claim 29 wherein the first one-way gas valve is arranged with respect to the liquid reservoir to cause air to enter the reservoir through the valve in response to motion of reservoir contents during motion of the iron during use.

31. The steam iron of claim 29 wherein the first one-way gas valve opens automatically to permit air to enter the reservoir in response to pressure within the reservoir falling to below a predetermined threshold pressure.

32. The steam iron of claim 31 wherein the predetermined threshold pressure is less than ambient atmospheric pressure.

33. The steam iron of claim 31 wherein the predetermined threshold pressure is substantially equal to ambient atmospheric pressure.

34. The steam iron of claim 29 wherein the drip valve is in the form of a channel defined between a movable rod and a wall separating the liquid reservoir and steam chamber.

35. The steam iron of claim 34 wherein the rod is operably connected to a knob exposed on the iron for manual manipulation by an operator.

36. The steam iron of claim 29 wherein the first one-way gas valve is located at one longitudinal end region of the liquid reservoir.

37. The steam iron of claim 29 wherein the first one-way gas valve is located at a forward end of the liquid reservoir.

38. The steam iron of claim 29 wherein the first gas valve is in the form of a ball check valve.

39. The steam iron of claim 29 wherein the second one-way gas valve opens automatically to permit air to leave the reservoir in response to pressure within the reservoir rising to above a predetermined maximum threshold pressure.

40. The steam iron of claim 39 wherein the predetermined maximum threshold pressure is greater than normal reservoir operating pressure.

41. The steam iron of claim 39 wherein the second one-way gas valve is manually openable for filling the liquid reservoir.

42. A steam iron comprising:

a sole plate with steam outlet openings in steam connection with a steam chamber;

a heater that heats the sole plate and the steam chamber for the purpose of generating steam;

a liquid reservoir extending longitudinally over a substantial length of the iron, the liquid reservoir including a drip valve for supplying the steam chamber with liquid from the liquid reservoir;

a pressure-equalizing passage extending between a first opening in the steam chamber and a second opening in a gas-tight region of the liquid reservoir; and a first one-way gas valve arranged between the liquid reservoir and ambient air, the valve opening automatically to permit ambient air to enter the liquid reservoir in response to longitudinal motion of liquid in the reservoir during use, while impeding fluid flow from the liquid reservoir to the ambient air to increase pressure within the reservoir.

43. The steam iron of claim 41 wherein the one-way gas valve is configured to open automatically when pressure within the reservoir falls below a predetermined threshold pressure.

44. The steam iron of claim 43 wherein the predetermined threshold pressure is less than ambient atmospheric pressure.

45. The steam iron of claim 43 wherein the predetermined threshold pressure is substantially equal to ambient atmospheric pressure.

46. The steam iron of claim 42 wherein the drip valve is in the form of a channel defined between a movable rod and a wall separating the liquid reservoir and steam chamber.

47. The steam iron of claim 46 wherein the rod is operably connected to a knob exposed on the iron for manual manipulation by an operator.

48. The steam iron of claim 46 wherein the rod also defines an internal cavity forming the pressure-equalizing passage.

49. The steam iron of claim 42 wherein the one-way gas valve is located at one longitudinal end region of the liquid reservoir.

50. The steam iron of claim 42 wherein the one-way gas valve is located at a forward end of the liquid reservoir.

51. The steam iron of claim 42 having two first one-way gas valves arranged between the liquid reservoir and ambient air to permit air to enter the liquid reservoir through the valve while impeding fluid flow from the liquid reservoir to the ambient air, the gas valves being disposed at opposite ends of the liquid reservoir.

52. The steam iron of claim 42 wherein the gas valve is in the form of a ball check valve.

53. The steam iron of claim 42 further comprising a second one-way gas valve arranged between the liquid reservoir and ambient air, to permit air to leave the liquid reservoir through the valve.

54. The steam iron of claim 53 wherein the second one-way gas valve opens automatically to permit air to leave the reservoir in response to pressure within the reservoir rising to above a predetermined maximum threshold pressure.

55. The steam iron of claim 54 wherein the predetermined maximum threshold pressure is greater than normal reservoir operating pressure.

56. The steam iron of claim 54 wherein the second one-way gas valve is manually openable for filling the liquid reservoir.

* * * * *